US006884176B2

(12) United States Patent
Jensen

(10) Patent No.: US 6,884,176 B2
(45) Date of Patent: Apr. 26, 2005

(54) SECURING HOLDING JAWS ON A TOOL RING FOR A NAIL MACHINE

(75) Inventor: Jørn Boie Jensen, Ebeltoft (DK)

(73) Assignee: Enkotech A/S, Skanderborg (DK)

( * ) Notice: Subject to any disclaimer, the term of this patent is extended or adjusted under 35 U.S.C. 154(b) by 151 days.

(21) Appl. No.: 10/443,185

(22) Filed: May 22, 2003

(65) Prior Publication Data

US 2004/0235578 A1 Nov. 25, 2004

(51) Int. Cl.[7] ..... B21G 3/00

(52) U.S. Cl. ..... 470/121; 470/34; 470/62; 470/110; 470/129; 470/140; 470/179

(58) Field of Search ..... 470/34, 40, 57, 470/62, 110, 121, 129, 140, 154, 156, 177, 179; 198/469.1, 470.1, 473.1, 478.1, 867.02, 867.11, 867.12, 803.3, 803.14, 803.15

(56) References Cited

U.S. PATENT DOCUMENTS 3,775,789 A * 12/1973 Dagley ..... 470/129
5,020,363 A * 6/1991 Schnaibel et al. ..... 73/119 A
5,050,260 A * 9/1991 Nielsen ..... 470/129
6,508,715 B1 * 1/2003 Jensen ..... 470/129
6,520,860 B1 * 2/2003 Jensen ..... 470/129

* cited by examiner

*Primary Examiner*—Ed Tolan
(74) *Attorney, Agent, or Firm*—Pitney Hardin LLP

(57) ABSTRACT

The present invention relates to aspects of securing holding jaws in nail machines, including a method, a machine, a tool ring and a holding jaw for such purposes. The novel aspects of the invention include that holding jaws are secured to a tool ring in a manner where a number of immovably secured passive fittings are used as well as a number of active fittings. It is hereby ensured that holding jaws may be e.g. replaced without loosening many other holding jaws, and that the holding jaws may be placed very precisely and in a manner, which is repeatable. It is also ensured that the holding jaws may be effectively and easily secured. The passive fittings will each provide at least one fix point from where one or more holding jaws may be lined up, in a manner where the interdependency between the secured holding jaws is reduced, whereby a larger degree of precision is obtained, also when a high number of holding jaws are involved, and also when the distance between the jaws are identical along the entire circumference of the tool ring.

12 Claims, 7 Drawing Sheets

SECURING HOLDING JAWS ON A TOOL RING FOR A NAIL MACHINE

BACKGROUND OF THE INVENTION

The present invention relates to aspects of securing holding jaws in nail machines, including a method, a machine, a tool ring and a holding jaw for such purposes.

For instance EP patent No 414 670 discloses nail machines for manufacturing elongate bodies with heads, such as nails, screws, tacks and other elongate bodies with heads, wherein the machine has a cutting station for cutting off individual pieces of wire that are subsequently received in a roller device that comprises a tool ring, said tool ring having an axis of rotation where about the tool ring can be caused to rotate; an outer and an inner surface that faces away from and towards, respectively, the axis of rotation of the tool ring, and a surface which is substantially perpendicular relative to the axis of rotation; and wherein the tool ring further comprises a plurality of holding jaws and means for positioning and securing the holding jaws at a mutual distance along the circumference of the tool ring; and wherein each holding jaw has a groove for receiving an elongate body longitudinally of said groove whereby the holding jaw is caused to serve as a clamp jaw for securing and positioning the elongate body.

SUMMARY OF THE INVENTION

Hereby, the holding jaw is able to contribute to securing the cut-off length of wire in order to enable that a head is rolled there onto, the holding jaw being configured such that the head is rolled out on said holding jaw.

The tool ring in these machines being configured for rotating about said axis of rotation, it is enabled that a continuous process is accomplished in which a plurality of holding jaws sequentially pass the point where the lengths of wire are cut off to enable that each cut-off length of wire is introduced into a holding jaw, following which the holding jaw is displaced away from the cutting station and towards the roller station, where the head is rolled onto the cut-off length of wire. Obviously, in order to achieve a high productivity for the machine, such machines receive many lengths of wire per time unit, and this presupposes that the tool ring rotates at a relatively high rate of rotation. This means that it is extremely important that the individual holding jaws are very accurately situated along the circumference of the tool ring.

Besides, it is obvious that the holding jaws are secured effectively so as to prevent them from breaking loose and displacing in particular during the rolling process.

In the known machine this problem has been solved in that the tool ring is provided with a substantially cylindrical and radially inwardly oriented surface on the tool ring; and wherein the inwardly oriented surface is provided with a plurality of holding jaws and a corresponding number of wedge-shaped spacer blocks that are secured in firm abutment on the inwardly oriented surface by means of one or more machine bolts that are screwed into the tool ring. By this solution a holding jaw and a spacer block are thus alternatingly arranged until the entire above-mentioned, inwardly oriented surface is covered with holding jaws and spacer blocks that abut on each other. When the spacer blocks are subsequently clamped against the tool ring, the above-described wedge-shape of the spacer blocks causes the holding jaws to be wedged firmly between the spacer blocks, and by loosening and securing, respectively, the individual spacer blocks it is possible to regulate the mutual distance between the holding jaws.

However, the above-mentioned clamping process in the known machine is very time-consuming, and in practice it can only be performed to standard by an operator having considerable experience. Besides, provided a single block or holding jaw is loosened, crushed or deformed during use of the machine, this may entail that all the spacer blocks and holding jaws configured in the tool ring must subsequently be adjusted following attachment or securing of the loose or destroyed spacer block or holding jaw. Also, these types of machines normally employ two tool rings, where holdings jaws on both tool rings co-operate on clamping elongate bodies between them. It is therefore imperative that co-operating pairs of holding jaws are positioned very accurately relative to each other. It is therefore especially desired that the obtained pattern in which holding jaws are placed may be obtained in a mirrored version on the co-operating tool ring, in order that each pair of jaws may function well.

Additionally, a development of the above-mentioned machine is known from U.S. Pat. No. 6,508,715 B1, which in general terms deals with aspects in a corresponding nail making process. To facilitate easier clamping of the holding jaws, independent holding trays are introduced. Each holding tray may contain one or more holding jaws. By the independent holding trays, the interdependence of the circumferential sequence of holding jaws and spacer blocks is avoided, and an easier and improved individual securing and adjustment is available. Embodiments include yoke-shaped trays, which are bolted to the tool ring via apertures placed in each end of the trays. The latter means, that holding jaws placed in two adjacent holding trays will be separated by at least two sets of bolts, i.e. one set for each of the two adjacent tray ends. This limits the maximum number of holding jaws that may be mounted on a tool ring. In the embodiments where more holding jaws are mounted in one holding tray, it is difficult to maintain identical distance, which is usually desired, between all the holding jaws. Identical distance may for instance be obtained with identically sized holding jaws combined with a width of each clamping block (spacer block) corresponding to the width of two adjacent tray ends. This provides a design limitation for the holding trays in connection with maximising the number of holding jaws on a tool ring.

One aspect of the present invention is to provide easy, effective and precise securing of holding jaws on a tool ring. Another aspect is to provide an improvement in securing a high number of holding jaws on a tool ring. Other aspects may be found in the description and the figures.

One concept of the invention involves a method of securing holding jaws in a machine for the manufacture of heads on elongate bodies, including nails, screws etc said machine comprising at least one tool ring having an axis of rotation about which the tool ring can be caused to rotate, said tool ring comprising at least one support surface substantially perpendicular relative to the axis of rotation, where the tool ring comprises a plurality of holding jaws and means for positioning and securing said holding jaws along the circumference of the tool ring on said support surface, where each of said holding jaws comprise at least one face, provided with a groove for receiving an elongate body longitudinally in said groove, and a first and a second side face as well as a back side, where at least the second side face is wedge-shaped, and where the tool ring further comprises a plurality of holding fittings, said fittings comprising a number of passive fittings and a number of active fittings, and where said passive fittings are secured immovably to the tool ring, and where said passive fittings each comprise at least one first holding surface, said first holding surface being placed in an angle equal to or smaller than 90 degrees with the support surface, where said first holding surface is adapted for co-operation with a holding jaw, and where said active fittings each comprise at least one wedge-shaped side adapted for co-operation with a wedge-shaped side of a holding jaw, and where a number of holding jaws, preferably the majority of the holding jaws, are secured each with the first side face against a first holding surface of a passive fitting and the back side against a support surface, as well as with an active fitting placed against the second side face of the holding jaw, and where the active fitting is secured to the tool ring, whereby said number of holding jaws each are secured at least between a support surface on the tool ring, a holding surface of a passive fitting and a wedge-shaped side of an active fitting, and where said active fitting is used for applying force on at least one holding jaw for securing said holding jaw to the tool ring.

It is hereby ensured that holding jaws may be e.g. replaced without loosening many other holding jaws, and that the holding jaws may be placed very precisely and in a manner, which is repeatable. It is also ensured that the holding jaws may be effectively and easily secured. The passive fittings will each provide at least one fixpoint from where one or more holding jaws may be lined up in a manner where the interdependency between the secured holding jaws is reduced, whereby a larger degree of precision is obtained, also when a high number of holding jaws are involved, and also when the distance between the jaws is identical along the entire circumference of the tool ring.

By the feature that the passive fittings are immovably secured, it is to be understood that a holding jaw may be secured against one side of such a fitting, without significant influence, i.e. movement, on any holding jaw being secured to an opposite side of said passive fitting.

The immovability of the passive fittings may alternatively be improved if the tool ring comprises a number of recesses in alignment with or adjacent to each support surface, where the passive fittings are placed and fastened in said recesses. As another alternative, at least one passive fitting may be integrated in the tool ring by being machined as a part of the tool ring, or by being welded, glued, or by any similar process, to the tool ring. Both alternatives may be combined.

In a further alternative way, or in combination, full or partial, with the above-mentioned, the holding jaws may be placed in pairs of two, between two consecutive passive holding fittings, said holding fittings comprising holding surfaces, said holding surfaces facing towards each other, said holding surfaces each being placed in an angle equal to or smaller than 90 degrees with the support surface, where the first holding jaw is placed with the first side face against the holding surface of the first passive holding fitting and the back side against a support surface, and where the second holding jaw is placed with the first side face against the holding surface of the second passive holding fitting and the back side against a support surface, and where an active holding fitting, said fitting comprising two opposite wedge-shaped sides adapted for co-operation with two holding jaws, is placed with its wedge-shaped sides against the second side faces of the first and the second holding jaws for co-operation, and where the active fitting is secured to the tool ring, whereby the two holding jaws each are secured at least between a support surface, a holding surface of a passive fitting and a wedge-shaped side of an active fitting. It is hereby obtained that holding jaws may be secured very precisely in pairs and in an easy manner.

Another concept of the invention involves a machine for the manufacture of heads on elongate bodies, including nails, screws etc wherein said machine comprises at least one tool ring having an axis of rotation about which the tool ring can be caused to rotate, said tool ring comprising at least one support surface substantially perpendicular relative to the axis of rotation, where the tool ring comprises a plurality of holding jaws and means for positioning is and securing said holding jaws along the circumference of the tool ring on said support surface, and where each of said holding jaws comprise at least one face provided with a groove for receiving an elongate body longitudinally in the said groove, and a first and a second side face as well as a back side, and where at least the second side face is wedge-shaped, and where the tool ring further comprises a plurality of holding fittings, said fittings comprising a number of passive fittings and a number of active fittings, and where said passive fittings are secured immovably to the tool ring, and where said passive fittings each comprise at least one first holding surface, said first holding surface being placed in an angle equal to or smaller than 90 degrees with the support surface, where said first holding surface is adapted for co-operation with a holding jaw, and where said active fittings each comprise at least one wedge-shaped side adapted for co-operation with a wedge-shaped side of a holding jaw, and where a number of holding jaws, preferably the majority of the holding jaws, are secured each with the first side face against a first holding surface of a passive fitting and the back side against a support surface, as well as with an active fitting placed against the second side face of the holding jaw, said active fitting being secured to the tool ring by bolting for securing said number of holding jaws at least between a support surface on the tool ring, a holding surface of a passive fitting and a wedge-shaped side of an active fitting.

One preferred embodiment may include that both the first and a second side face of the holding jaws are wedge-shaped, whereby the securing of the holding jaws may be improved.

In another preferred embodiment, the wedge-shape of the holding jaws may include angles less than 90 degrees with a plane perpendicular to the axis of rotation as well as less than 90 degrees with a plane parallel with the axis of rotation. This ensures that the forces exerted on the holding jaws by the active fittings may press the jaws both against the support surface of the tool ring as well as against a second support surface placed perpendicularly, or substantially perpendicularly, to the first mentioned support surface, which in combination provide a very secure securing of the holding jaws.

In a further preferred embodiment, the passive holding fittings can each comprise at least one integrated part, such as a flange etc where said part is adapted to the tool ring for fastening by fastening means in at least one position, said position lying on a smaller radius from the axis of rotation than the holding jaws. In that position free space is available, which may be used to e.g. secure the passive fitting with one or more bolts etc which there would otherwise not be room for.

In a still further preferred embodiment, the passive holding fittings may each be fastened by fastening means comprising at least one bolt, which enables a secure and safe fastening, and which can be tightened with sufficient torque to ensure immovability.

In yet a further preferred embodiment, each passive holding fitting may be fastened by fastening means comprising at least one bolt inserted from the side of the tool ring, which side is opposite to the side, where the passive holding fittings are placed. By using the opposite side it is obtained that the bolt may be placed in a position, where room for the head of the bolt would not be available on the other side.

In a still further preferred embodiment, the machine may comprise two tool rings located opposite each other in such a manner that their respective axes of rotation intersect in a blunt angle, in a manner such that opposed holding jaws on the two tool rings are pressed against each other only along a part of the tool ring peripheries.

A further concept of the invention involves a tool ring for securing preferably elongate bodies, including nails, screws etc in a machine for the manufacture of heads on elongate bodies, said tool ring having an axis of rotation about which the tool ring can be caused to rotate, said tool ring comprising at least one support surface substantially perpendicular relative to the axis of rotation, where the tool ring comprises a plurality of holding jaws and means for positioning and securing said holding jaws along the circumference of the tool ring on said support surface, and where each of said holding jaws comprise at least one face provided with a groove for receiving an elongate body longitudinally in the said groove, and a first and a second side face as well as a back side, and where at least the second side face is wedge-shaped, and where the tool ring further comprises a plurality of holding fittings, said fittings comprising a number of passive fittings and a number of active fittings, and where said passive fittings are secured immovably to the tool ring, and where said passive fittings each comprise at least one first holding surface, said first holding surface being placed in an angle equal to or smaller than 90 degrees with the support surface, where said first holding surface is adapted for co-operation with a holding jaw, and where said active fittings each comprise at least one wedge-shaped side adapted for co-operation with a wedge-shaped side of a holding jaw, and where a number of holding jaws, preferably the majority of the holding jaws, are secured each with the first side face against a first holding surface of a passive fitting and the back side against a support surface, as well as with an active fitting placed against the second side face of the holding jaw, said active fitting being secured to the tool ring by bolting for securing said number of holding jaws at least between a support surface on the tool ring, a holding surface of a passive fitting and a wedge-shaped side of an active fitting.

BRIEF DESCRIPTION OF THE DRAWINGS

In the following the invention is described with reference to the drawings, which display examples of embodiments of the invention.

DETAILED DESCRIPTION OF THE PREFERRED EMBODIMENTS

Figure 1:
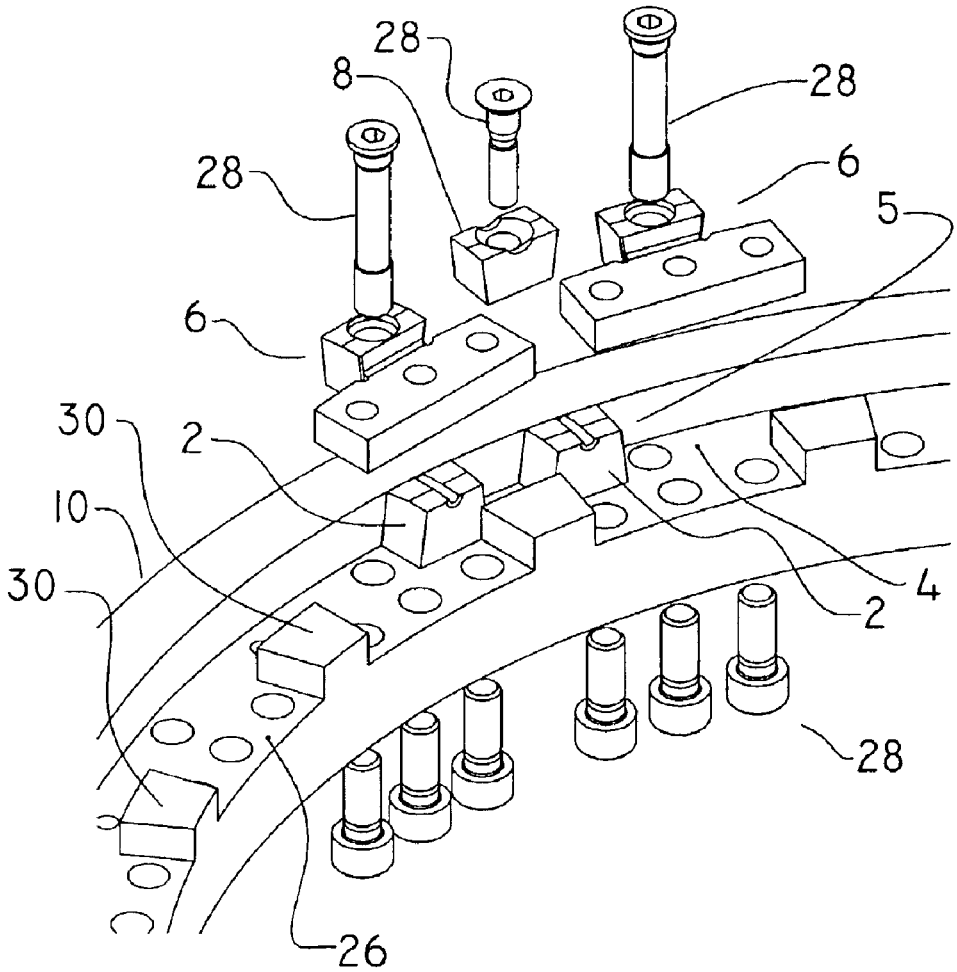
FIG. 1 shows a tool ring including elements of the invention in an exploded view.
Figure 2:
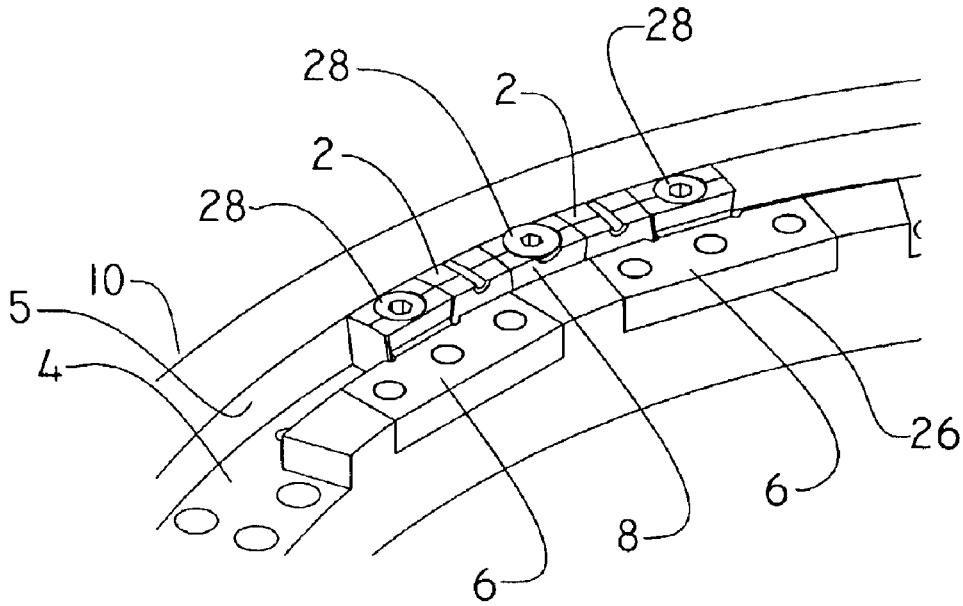
FIG. 2 shows a section of a tool ring with secured holding jaws in an elevated view.
Figure 3:
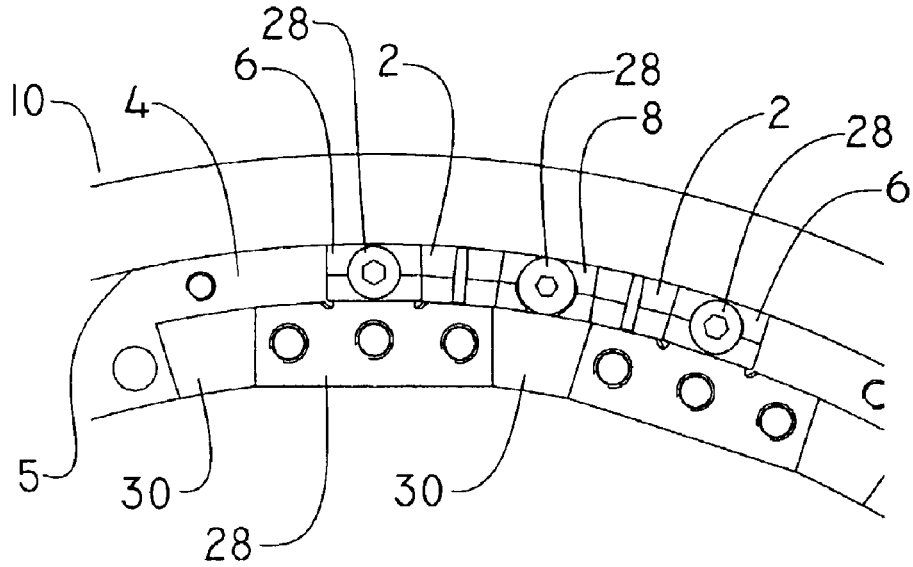
FIG. 3 shows a section of a tool ring with secured holding jaws seen from above.

FIGS. 1–3 display tool rings 10 for securing preferably elongate bodies, including nails, screws etc in machine for the manufacture of heads on elongate bodies, said tool ring having an axis of rotation about which the tool ring can be caused to rotate, said tool ring 10 comprising at least one support surface 4 substantially perpendicular relative to the axis of rotation, where the tool ring 10 comprises a plurality of holding jaws 2 and means for positioning and securing said holding jaws along the circumference of the tool ring 10 on said support surface 4. The tool ring 10 further comprises a plurality of holding fittings 6 and 8, said fittings comprising a number of passive fittings 6 and a number of active fittings 8. The passive fittings 6 are secured immovably to the tool ring 10. The active fittings 8 each comprise at least one wedge-shaped side adapted for co-operation with a wedge-shaped side of a holding jaw 2, such that the holding jaws can be secured each with one side against a passive fitting 6 and its back side against a support surface 4, as well as with an active fitting 8 placed against an opposite side of the holding jaw 2, where the active fitting 8 is secured to the tool ring 10 by bolting with at least one bolt 28. Also the passive fittings 6 are fastened with bolts 28.

In a preferred embodiment, the tool ring 10 comprises a further support surface 5, which section by section is substantially perpendicular to the support surface 4. This provides additional support for the holding jaw 2.

The passive fittings 6 may be placed in a recess 26 formed between two upstanding members 30 to secure the immovability of the passive fittings 6. In FIGS. 1–3 the recesses 26 are placed adjacent to the part of the support surface 4, on which the holding jaws 2 are supported, but the recesses may also be placed in alignment with the holding jaws 2.

Other ways of securing immovability are bolting, welding, gluing, or anything similar.

On FIG. 1 it is displayed that bolts 28 for fastening and securing the passive fittings 6 are to be inserted from the side of the tool ring, which is opposite to the support surface 4.

Figure 10:
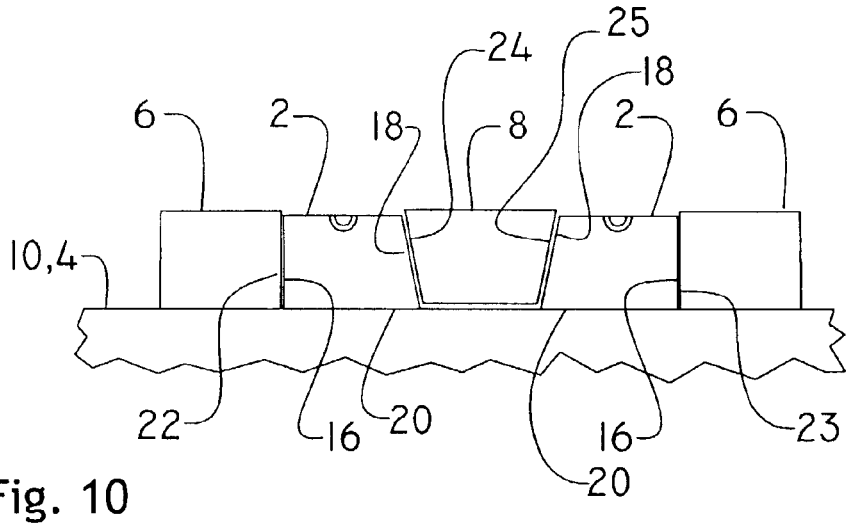
FIG. 10 shows a simplified sectional view of another tool ring with holding jaws secured seen in a front view.

The principle of securing holding jaws 2 as displayed in FIGS. 1–3 substantially corresponds to the principle displayed in FIG. 10.

Figure 4A:
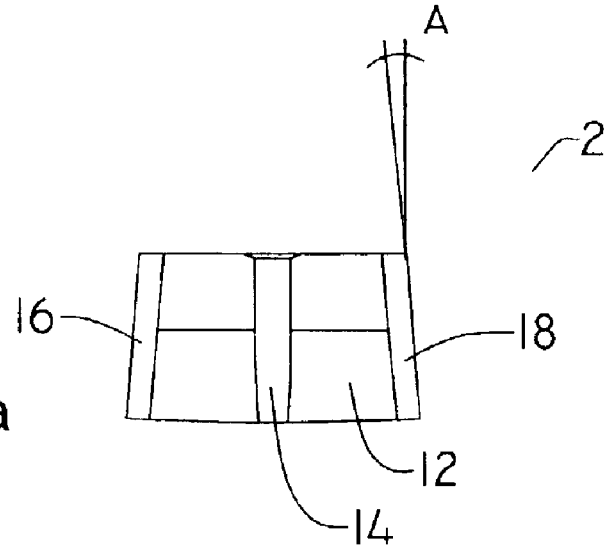
FIGS. 4*a–c* show a holding jaw in a front, top and elevated view.
Figure 4B:
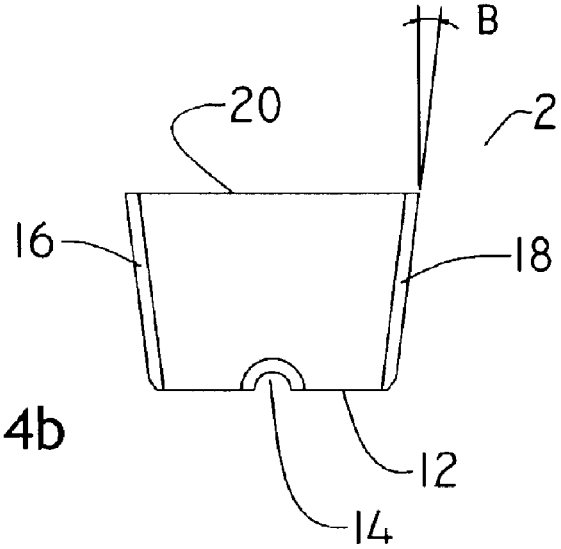
Figure 4C:
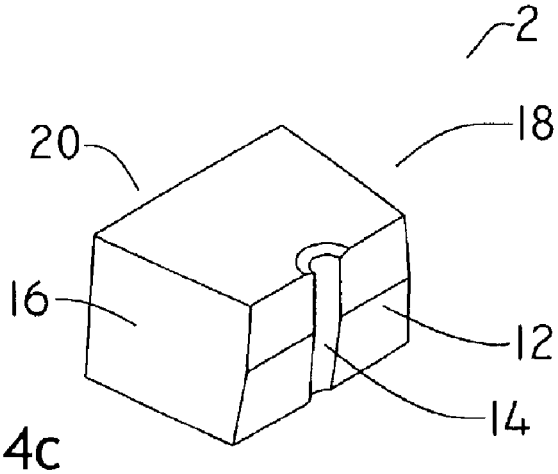

FIG. 4*a–c* display a holding jaw 2 comprising at least one face 12, which is provided with a groove 14 for receiving an elongate body longitudinally in said groove, and a first side face 16 and a second side face 18 as well as a back side 20. At least the second side face 18 is wedge-shaped, but also the first side 16 may be wedge-shaped. Preferably both sides 16 and 18 are wedge-shaped, and the jaw 2 substantially symmetric about a symmetry plane intersecting the bottom of the groove 14. The wedge-shape at least involves that the side 18 is placed under an angle B, which enables that a corresponding active fitting 8 may provide a force with a component in the direction of the back side 20, and hence press the jaw 2 towards a support surface 4 of a tool ring 10. The side 16 may also have an angle A, which enables that a corresponding active fitting 8 may provide a force with a component, which will press the jaw 2 towards a support surface 5 of a tool ring 10. Preferably the side 18 is placed under both angles B and A, said angles being preferably more than 2 degrees, and more preferably between 2 and 15 degrees.

Figure 5A:
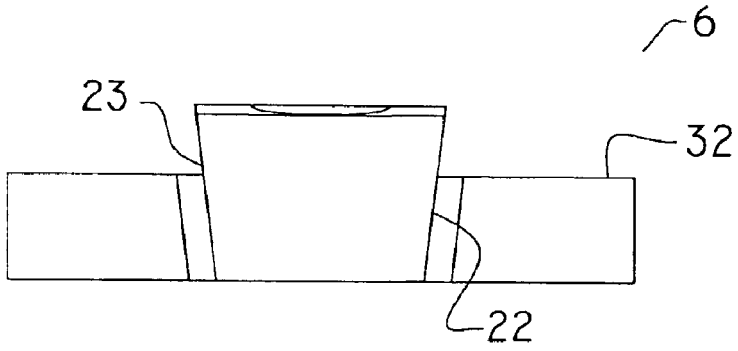
FIGS. 5*a–c* show a passive holding fitting in a front, top and elevated view.
Figure 5B:
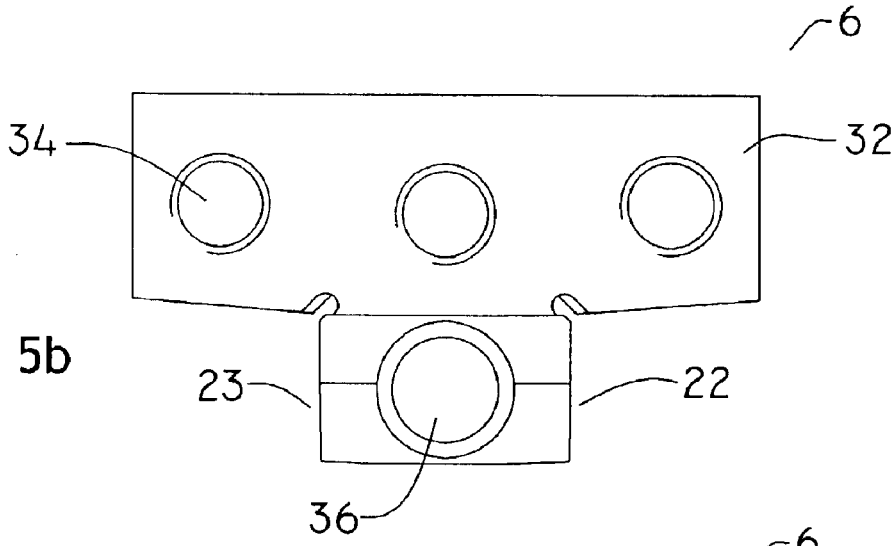
Figure 5C:
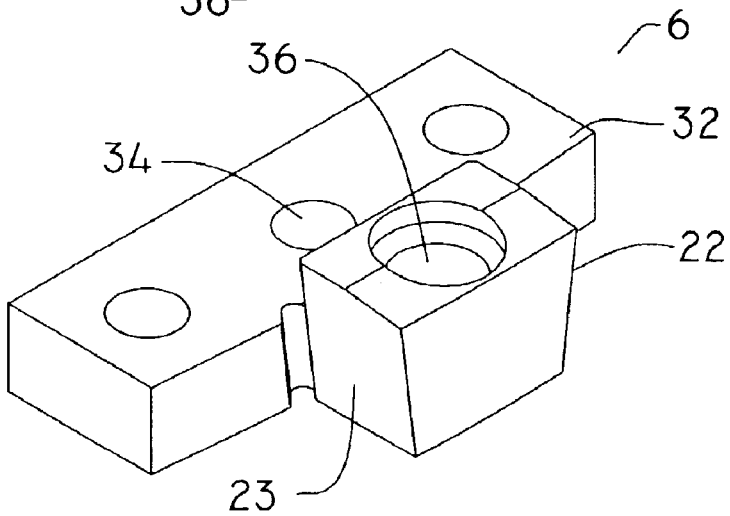

FIGS. 5*a–c* display a passive holding fitting 6 adapted for being secured immovably to a tool ring 10. The fitting comprises at least one first holding surface 22, which is adapted for co-operation with a holding jaw 2. In this embodiment, a second holding surface 23 is placed substantially opposite the first holding surface 22. The fitting 6 is provided with a hole 36 for insertion of a bolt for securing the fitting to a tool ring 10. The fitting 6 shown further comprises an integrated part, displayed as a flange 32, which is adapted for being fastened to a tool ring 10 by bolts via 3 threaded holes 34. The flange 32 is adapted for a position on a tool ring 10, said position lying on a smaller radius from the axis of rotation than the holding jaws 2. The passive fitting 6, either as a whole or merely the integrated part, such as a flange 32, may be adapted for co-operation with a recess 26 in a tool ring 10.

Figure 6A:
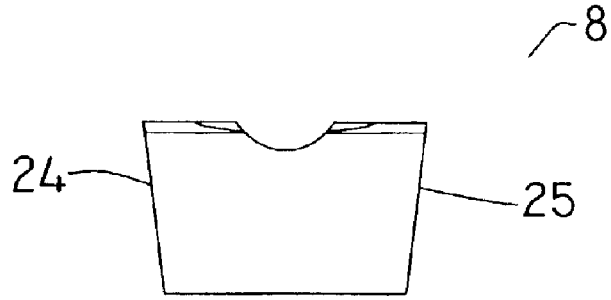
FIGS. 6*a–c* show an active holding fitting in a front, top and elevated view.
Figure 6B:
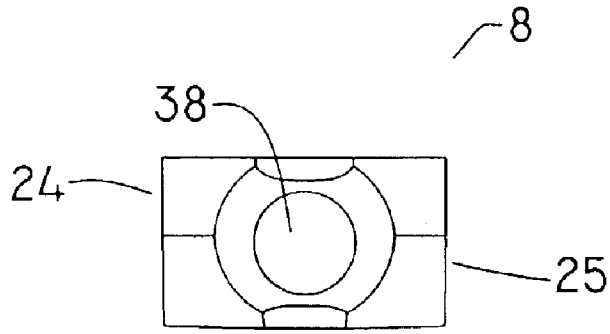
Figure 6C:
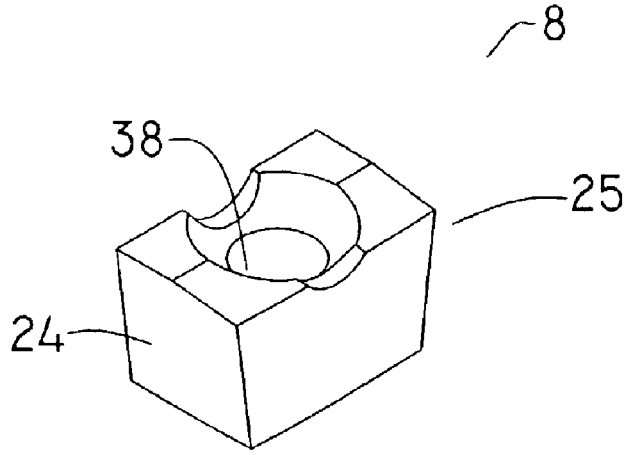

FIGS. 6*a–c* display an active holding fitting 8. The active fitting 8 comprises at least one wedge-shaped side 24 adapted for co-operation with a wedge-shaped side of a holding jaw 2. The active fitting 8 is adapted for being placed against a side face of at least one holding jaw 2 to apply force to it for securing the holding jaw to a tool ring 10. The fitting 8 comprises a hole 38, which is used for insertion of a bolt for connection to a tool ring 10. In the shown embodiment, the fitting comprises two wedge-shaped sides 24 and 25.

Figure 7:
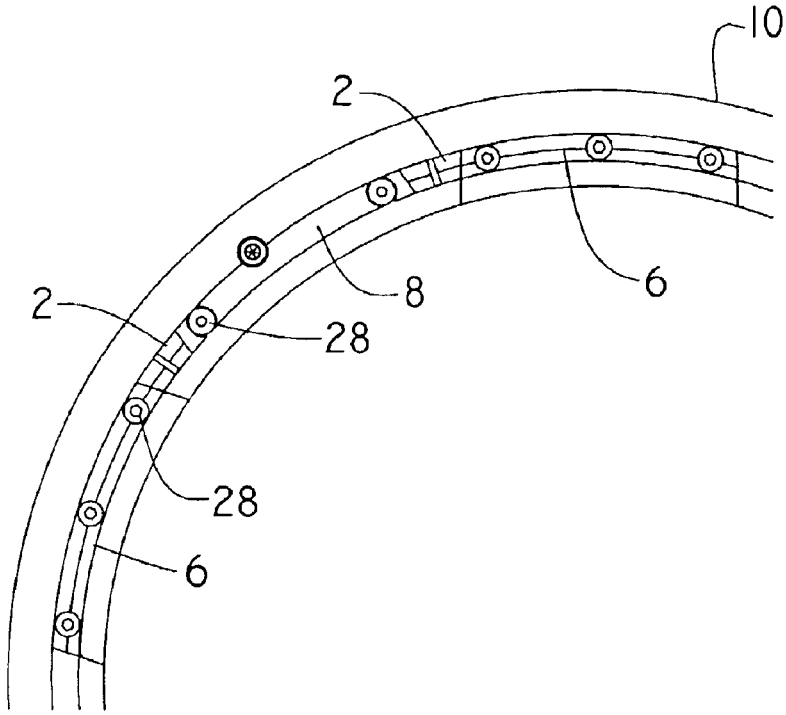
FIG. 7 shows a section of a tool ring including elements of the invention seen from above.

FIG. 7 displays a section of a tool ring 10 including two secured holding jaws 2, an active holding fitting 8 and two passive, immovably secured holding fittings 6. The shown holding jaws 2 are wedge-shaped, said wedge-shape including angles less than 90 degrees with a plane perpendicular to the axis of rotation as well as less than 90 degrees with a plane parallel with the axis of rotation. The holding fittings 6 and 8 are secured by bolts 28 to the tool ring 10. From FIG. 7 it may be recognised that the distance along the circumference of the tool ring 10 between the holding jaws 2 is relatively larger than the corresponding distance displayed on FIGS. 2 and 3.

Figure 8:
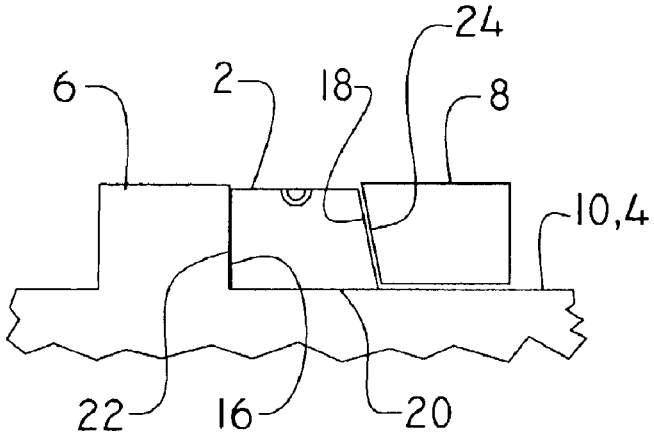
FIG. 8 shows a simplified sectional view of a further tool ring with a holding jaw secured seen in a front view.

FIG. 8 displays one principle of the invention. On a support surface 4 of a tool ring 10 a holding jaw 2 is secured between a passive holding fitting 6 and an active holding fitting 8. The jaw comprises a back side 20 facing towards the support surface 4, a side face 16 facing towards a holding surface 22 on the passive fitting 6 and a wedge-shaped side face 18 facing a wedge-shaped side 24 of the active fitting 8 for co-operation. The passive fitting 6 is integrated with the tool ring 10 by being machined as a part of it, whereby it is secured immovably to the tool ring 10. The holding surface 22 of the passive fitting is placed in an angle equal to or smaller than 90 degrees (shown as 90 degrees) with the support surface 4 and is adapted for co-operation with a holding jaw 2. The active fitting 8 comprises at least one wedge-shaped side 24 adapted for co-operation with a wedge-shaped side of a holding jaw 2. The holding jaw 2 is hereby secured with a first side face 16 against a first holding surface 22 of a passive fitting 6 and the back side 20 against a support surface 4, as well as with an active fitting 8 placed against a second side face 18 of the holding jaw 2, said active fitting 8 being secured to the tool ring 10 by bolting (not shown) for securing the holding jaw 2 at least between a support surface 4, a holding surface 22 of a passive fitting 6 and a wedge-shaped side 24 of an active fitting 8.

Figure 9:
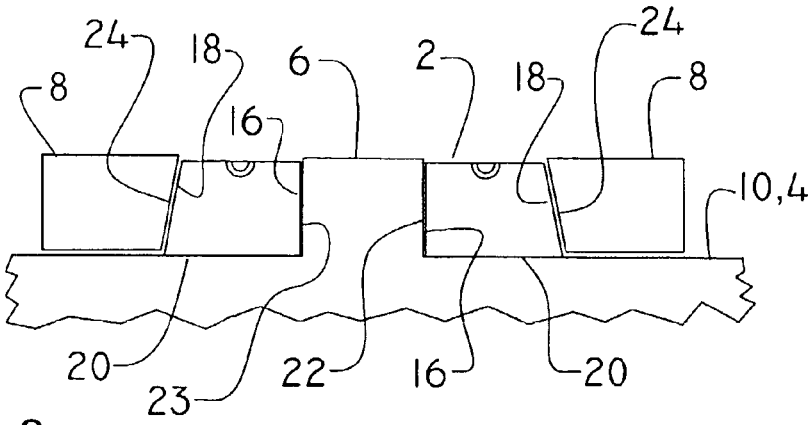
FIG. 9 shows a simplified sectional view of a still further tool ring with holding jaws secured seen in a front view.

FIG. 9 displays another principle of the invention. On a support surface 4 of a tool ring 10 two holding jaws 2 are secured, each between a passive holding fitting 6 and an active holding fitting 8. Each jaw 2 comprises a back side 20 facing towards the support surface 4, a side face 16 facing towards a holding surface 22 and 23, respectively, on a passive fitting 6 and a wedge-shaped side face 18 facing a wedge-shaped side 24 of an active fitting 8 for co-operation. The passive fitting 6 is integrated with the tool ring 10 by being machined as a part of it, whereby it is secured immovably to the tool ring 10. The holding surfaces 22 and 23 of the passive fitting are placed in an angle equal to or smaller than 90 degrees (shown as 90 degrees) with the support surface 4 and are each adapted for co-operation with a holding jaw 2. The active fittings 8 each comprise at least one wedge-shaped side 24 adapted for co-operation with a wedge-shaped side of a holding jaw 2. Each holding jaw 2 is hereby secured with a first side face 16 against a first holding surface 22 and 23, respectively, of a passive fitting 6 and the back side 20 against a support surface 4, as well as with an active fitting 8 placed against a second side face 18 of the holding jaw 2, said active fittings 8 being secured to the tool ring 10 by bolting (not shown) for securing the holding jaws 2 at least between a support surface 4, a holding surface 22 and 23, respectively, of a passive fitting 6 and a wedge-shaped side 24 of an active fitting 8.

FIG. 10 displays a further principle of the invention. On a support surface 4 of a tool ring 10 two holding jaws 2 are secured, each of them between a passive holding fitting 6 and an active holding fitting 8. Each jaw 2 comprises a back side 20 facing towards the support surface 4, a side face 16 facing towards a holding surface 22 and 23, respectively, on a passive fitting 6 and a wedge-shaped side face 18 facing a wedge-shaped side 24 and 25, respectively, of an active fitting 8 for co-operation. The passive fittings 6 are secured to the tool ring 10 by bolting (not shown), whereby it is secured immovably to the tool ring 10. The holding surfaces 22 and 23 of the passive fittings are placed in an angle equal to or smaller than 90 degrees (shown as 90 degrees) with the support surface 4 and are each adapted for co-operation with a holding jaw 2. The active fitting 8 comprises two wedge-shaped sides 24 and 25 each adapted for co-operation with a wedge-shaped side of a holding jaw 2. Each holding jaw 2 is hereby secured with a first side face 16 against a first holding surface 22 and 23, respectively, of a passive fitting 6 and the back side 20 against a support surface 4, as well as with an active fitting 8 placed against a second side face 18 of the holding jaws 2, said active fitting 8 being secured to the tool ring 10 by bolting (not shown) for securing the holding jaws 2 at least between a support surface 4, a holding surface 22 and 23, respectively, of a passive fitting 6 and a wedge-shaped side 24 and 25, respectively, of the active fitting 8.

Figure 11:
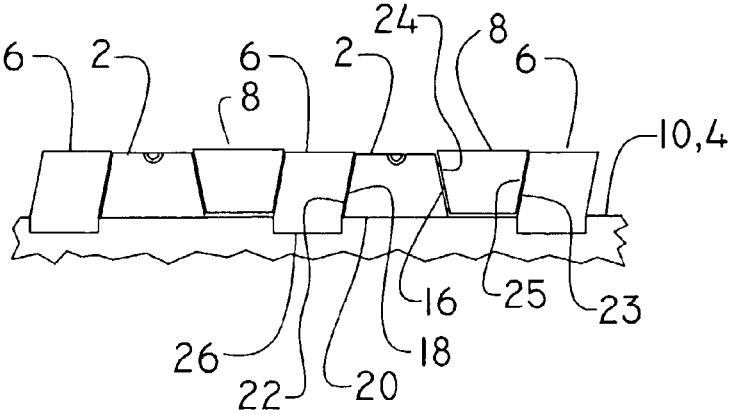
FIG. 11 shows a simplified sectional view of yet a further tool ring with holding jaws secured seen in a front view.

FIG. 11 displays yet another principle of the invention. On a support surface 4 of a tool ring 10 holding jaws 2 are secured, each of them between a passive holding fitting 6 and an active holding fitting 8. The jaw 2 comprises a back side 20 facing towards the support surface 4, a side face 18 facing towards a holding surface 22 on a passive fitting 6 and a wedge-shaped side face 16 facing a wedge-shaped side 24 of an active fitting 8 for co-operation. The passive fittings 6 are placed in recesses 26 in the tool ring 10 for being immovably secured. The holding surface 22 of the passive fitting is placed in an angle smaller than 90 degrees with the support surface 4 to provide a wedge-shape, and is adapted for co-operation with a holding jaw 2. The active fittings 8 each comprise a wedge-shaped side 24 adapted for co-operation with a wedge-shaped side of a holding jaw 2. The holding jaws 2 are hereby secured with a first side face 18 against a first holding surface 22 of a passive fitting 6 and the back side 20 against a support surface 4, as well as with an active fitting 8 placed against a second side face 16 of the holding jaw 2, said active fitting 8 being secured to the tool ring 10 by bolting (not shown) for securing the holding jaws 2 at least between a support surface 4, a holding surface 22 of a passive fitting 6 and a wedge-shaped side 24 of an active fitting 8. The active fittings 8 each further comprise a second wedge-shaped side 25 adapted for co-operation with a holding surface 23 of a passive holding fitting 6.

In the embodiments shown e.g. in FIGS. 10 and 11 the wedge-shaped sides 24 and 25 of the active fittings 8 are preferably placed symmetrically in order to balance the sideway reactions from the holding jaws 2 (FIG. 10) and the holding jaw 2 and the surface 23 of the fitting 6 (FIG. 11), respectively, when the not shown at least one bolt is tightened to secure the fitting 8.

It is to be understood that the invention as disclosed in the description and in the figures may be modified and changed and still be within the scope of the invention as claimed hereinafter.

What is claimed is:

1. A method of securing holding jaws in a machine for the manufacture of heads on elongate bodies, including nails, screws etc said machine comprising at least one tool ring having an axis of rotation about which the tool ring can be caused to rotate, said tool ring comprising at least one support surface substantially perpendicular relative to the axis of rotation, where the tool ring comprises a plurality of holding jaws and means for positioning and securing said holding jaws along the circumference of the tool ring on said support surface, where each of said holding jaws comprise at least one face, provided with a groove for receiving an elongate body longitudinally in the said groove, and a first and a second side face as well as a back side, where at least the second side face is wedge-shaped, and where the tool ring further comprises a plurality of holding fittings, said fittings comprising a number of passive fittings and a number of active fittings, and where said passive fittings are secured immovably to the tool ring, and where said passive fittings each comprise at least one first holding surface, said first holding surface being placed in an angle equal to or smaller than 90 degrees with the support surface, where said first holding surface is adapted for co-operation with a holding jaw, and where said active fittings each comprise at least one wedge-shaped side adapted for co-operation with a wedge-shaped side of a holding jaw, and where a number of holding jaws, preferably the majority of the holding jaws, are secured each with the first side face against a first holding surface of a passive fitting and the back side against a support surface, as well as with an active fitting placed against the second side face of the holding jaw, and where the active fitting is secured to the tool ring, whereby said number of holding jaws each are secured at least between a support surface on the tool ring, a holding surface of a passive fitting and a wedge-shaped side of an active fitting, and where said active fitting is used for applying force on at least one holding jaw for securing said holding jaw to the tool ring.

2. A method according to claim 1, wherein the tool ring comprises a number of recesses in alignment with or adjacent to each support surface, where passive fittings are placed and fastened in said recesses.

3. A method according to claim 1, wherein at least one passive fitting is integrated in the tool ring by being machined as a part of the tool ring, or by being welded, glued, or any similar process, to the tool ring.

4. A method according to claim 1, wherein the holding jaws are placed in pairs of two, between two consecutive passive holding fittings, said holding fittings comprising holding surfaces, said holding surfaces facing towards each other, said holding surfaces each being placed in an angle equal to or smaller than 90 degrees with the support surface, where the first holding jaw is placed with the first side face against the holding surface of the first passive holding fitting and the back side against a support surface, and where the second holding jaw is placed with the first side face against the holding surface of the second passive holding fitting and the back side against a support surface, and where an active holding fitting, said fitting comprising two opposite wedge-shaped sides adapted for co-operation with two holding jaws, is placed with its wedge-shaped sides against the second side faces of the first and the second holding jaws for co-operation, and where the active fitting is secured to the tool ring, whereby the two holding jaws each are secured at least between a support surface, a holding surface of a passive fitting and a wedge-shaped side of an active fitting.

5. A machine for the manufacture of heads on elongate bodies, including nails and screws, said machine employing a method in accordance with claim 1, wherein said machine comprises at least one tool ring having an axis of rotation about which the tool ring can be caused to rotate, said tool ring comprising at least one support surface substantially perpendicular relative to the axis of rotation, where the tool ring comprises a plurality of holding jaws and means for positioning and securing said holding jaws along the circumference of the tool ring on said support surface, and where each of said holding jaws comprise at least one face, provided with a groove for receiving an elongate body longitudinally in the said groove, and a first and a second side face as well as a back side, and where at least the second side face is wedge-shaped, and where the tool ring further comprises a plurality of holding fittings, said fittings comprising a number of passive fittings and a number of active fittings, and where said passive fittings are secured immovably to the tool ring, and where said passive fittings each comprise at least one first holding surface, said first holding surface being placed in an angle equal to or smaller than 90 degrees with the support surface, where said first holding surface is adapted for co-operation with a holding jaw, and where said active fittings each comprise at least one wedge-shaped side adapted for co-operation with a wedge-shaped side of a holding jaw, and where a number of holding jaws, preferably the majority of the holding jaws, are secured each with the first side face against a first holding surface of a passive fitting and the back side against a support surface on the tool ring, as well as with an active fitting placed against the second side face of the holding jaw, said active fitting being secured to the tool ring by bolting for securing said number of holding jaws at least between a support surface, a holding surface of a passive fitting and a wedge shaped side of an active fitting.

6. A machine according to claim 5, wherein the passive holding fittings each comprise at least one integrated flange part, where said part is adapted to the tool ring for fastening by fastening means in at least one position, said position lying on a smaller radius from the axis of rotation than the holding jaws.

7. A machine according to claim 5, wherein the passive holding fittings each are fastened by fastening means comprising at least one bolt.

8. A machine according to claim 5, wherein each passive holding fitting is fastened by fastening means comprising at least one bolt inserted from the side of the tool ring, which side is opposite to the side where the passive holding fittings are placed.

9. A machine according to claim 5, wherein the machine comprises two tool rings located opposite each other in such a manner that their respective axes of rotation intersect in a blunt angle in a manner such that opposed holding jaws on the two tool rings are pressed against each other only along a part of the tool ring peripheries.

10. A holding jaw for the manufacture of heads on elongate bodies in a machine according to claim 5, wherein both the first and a second side face of the holding jaw is wedge-shaped.

11. A holding jaw according to claim 10, wherein the wedge-shape of the holding jaw include angles less than 90 degrees with a plane perpendicular to the axis of rotation as well as less than 90 degrees with a plane parallel with the axis of rotation.

12. A tool ring for securing preferably elongate bodies, including nails and screws, in a machine for the manufacture of heads on elongate bodies, said tool ring having an axis of rotation about which the tool ring can be caused to rotate, said tool ring comprising at least one support surface substantially perpendicular relative to the axis of rotation, where the tool ring comprises a plurality of holding jaws and means for positioning and securing said holding jaws along the circumference of the tool ring on said support surface, and where each of said holding jaws comprise at least one face, provided with a groove for receiving an elongate body longitudinally in the said groove, and a first and a second side face as well as a back side, and where at least the second side face is wedge-shaped, and where the tool ring further comprises a plurality of holding fittings, said fittings comprising a number of passive fittings and a number of active fittings, and where said passive fittings are secured immovably to the tool ring, and where said passive fittings each comprise at least one first holding surface, said first holding surface being placed in an angle equal to or smaller than 90 degrees with the support surface, where said first holding surface is adapted for co-operation with a holding jaw, and where said active fittings each comprise at least one wedge-shaped side adapted for co-operation with a wedge-shaped side of a holding jaw, and where a number of holding jaws, preferably the majority of the holding jaws, are secured each with the first side face against a first holding surface of a passive fitting and the back side against a support surface, as well as with an active fitting placed against the second side face of the holding jaw, said active fitting being secured to the tool ring by bolting for securing said number of holding jaws at least between a support surface on the tool ring, a holding surface of a passive fitting and a wedge-shaped side of an active fitting.

* * * * *

UNITED STATES PATENT AND TRADEMARK OFFICE

CERTIFICATE OF CORRECTION

PATENT NO. : 6,884,176 B2
APPLICATION NO. : 10/443185
DATED : April 26, 2005
INVENTOR(S) : Jorn Boie Jensen It is certified that error appears in the above-identified patent and that said Letters Patent is hereby corrected as shown below:

On the Title Page of the Patent, item (73) Assignee: Please correct "Enkotech A/S" to --Enkotec A/S--.

Signed and Sealed this

Twentieth Day of May, 2008

JON W. DUDAS
*Director of the United States Patent and Trademark Office*